US005845582A

United States Patent [19]

Coester et al.

[11] Patent Number: 5,845,582

[45] Date of Patent: Dec. 8, 1998

[54] SLOT SEALING SYSTEM FOR A PNEUMATIC TRANSPORTATION SYSTEM GUIDEWAY

[75] Inventors: Oskar Hans Wolfgang Coester; Carlos Antonio Campani, both of Porto Alegre, Brazil

[73] Assignee: Aeromovel Global Corporation, Cayman Islands

[21] Appl. No.: 970,040

[22] Filed: Nov. 13, 1997

[51] Int. Cl.[6] ..... B61B 13/12

[52] U.S. Cl. ..... 104/156; 104/161

[58] Field of Search ..... 104/155, 156, 104/161, 139; 92/88; 244/63

[56] References Cited

U.S. PATENT DOCUMENTS

| | | | |
|---|---|---|---|
| 409,769 | 8/1889 | Bodefeld . | |
| 450,958 | 4/1891 | Benson | 104/156 |
| 3,090,328 | 5/1963 | Berggren | 104/138 |
| 3,148,845 | 9/1964 | Buchwald . | |
| 4,164,893 | 8/1979 | Granbom . | |
| 4,240,599 | 12/1980 | Hammond | 244/63 |
| 4,252,285 | 2/1981 | Hammond | 244/63 |
| 4,347,791 | 9/1982 | Mandros | 104/156 |
| 4,555,980 | 12/1985 | Hoglund . | |
| 4,567,817 | 2/1986 | Fleischer . | |
| 4,587,906 | 5/1986 | Coester | 104/156 |
| 4,617,857 | 10/1986 | Kedzierski | 92/88 |
| 4,658,732 | 4/1987 | Coester | 104/156 |
| 4,733,604 | 3/1988 | Lipinski . | |

FOREIGN PATENT DOCUMENTS

| | | | |
|---|---|---|---|
| 6885 | 8/1835 | France | 104/161 |
| 12527 | 11/1844 | France | 104/156 |
| 10443 | 6/1844 | United Kingdom | 104/156 |
| 10731 | 6/1845 | United Kingdom | 104/161 |
| 10471 | 7/1845 | United Kingdom | 104/156 |

*Primary Examiner*—S. Joseph Morano
*Attorney, Agent, or Firm*—Donald L. Beeson

[57] ABSTRACT

An improved system for sealing a slot (37) in the guideway (13) of a pneumatic transportation system includes two separate pairs of sealing flaps for producing two separate opposed seal interfaces (47, 49) through which a travelling pylon (18) connecting a propulsion plate (17) to a vehicle (15) on the guideway can pass. A first pair of sealing flaps **(43*a*, 43*b*) provides a negative pressure seal and a second pair of sealing flaps (49*a*, 49*b*)** provides a positive pressure seal. The sealing flaps contact the travelling pylons along their distal ends only, so as to produce minimum deflection of the seal and minimum mechanical resistance against the pylon. The slot seal system of the invention is relatively easy to install from outside the vehicle guideway and produces no cavities in the top of the guideway in which moisture and debris can accumulate.

12 Claims, 5 Drawing Sheets

SLOT SEALING SYSTEM FOR A PNEUMATIC TRANSPORTATION SYSTEM GUIDEWAY

BACKGROUND OF THE INVENTION

The present invention generally relates to pneumatic transportation systems having an air duct running below a guideway support platform for receiving propulsion plates used to propel vehicles on guideway tracks on top of the platform. The invention more particularly relates to the sealing of the slot provided in the guideway to accommodate travelling pylons used to connect the vehicle propulsion plates to the bottom of the propelled vehicles.

Pneumatic transportation systems having vehicles that are pneumatically propelled by means of propulsion plates connected to the vehicles are well known. In such systems, the propulsion plates, which are deployed in an air duct running parallel to the vehicle guideway tracks, are typically connected to the vehicle's wheel carriages by means of pylons which must pass through a longitudinal guideway slot fitted with a seal to prevent the escape of air from the system. Such a transportation system is described in U.S. Pat. No. 4,658,732 issued to Oskar H. W. Coester, wherein freight and/or passenger vehicles are pushed and/or pulled by positive and negative air pressures developed in advance of and behind the vehicle's propulsion plates by controlled air flow in the guideway's air duct. In the Coester system, the seal for the guideway slot therefore must operate in both positive and negative air pressure conditions.

One early approach to sealing the guideway slot was simply to provide a single pair of opposed, upwardly projecting sealing flaps over the top of the guideway slot. However, such slot seals were relatively inefficient in that positive pressure in the air duct of the guideway, that is, pressure greater than the outside atmospheric pressure, would tend to separate the sealing flaps thereby impairing their sealing function. This problem is solved by the sealing configuration described in the above-mentioned U.S. Pat. No. 4,658,732, which consists of two overlapping strips of resilient sealing material angled from the bottom edge of one side of the guideway slot to the top edge of the other side of the guideway slot. While operating equally as well in positive and negative pressure conditions, this overlapping seal configuration has a number of disadvantages. The first is that seal is still relatively inefficient in that the pylons passing through the seal produce substantial separation of the seal's two opposing flaps, thereby providing a source of air leakage around the pylons. Also, the overlapping flaps of the seal create significant mechanical resistance to the pylons because of the relatively large area of contact between the pylons and the overlapping flaps. Such resistance produces wear on the seal components and results in drag on the vehicle which increases system energy requirements. The angulation of the seal further creates a cavity at the top of the seal in which moisture and debris detrimental to the operation and life of the seal can collect. (In cold climates, damage can result when moisture collected in the cavity freezes.) Still further, the seal is relatively difficult to install, because it requires that the installer enter into the air duct to secure the seal where it attaches at the bottom corner of the slot.

The present invention overcomes these disadvantages by providing an efficient sealing system for the guideway slot of a pneumatic transportation system guideway which produces relatively little mechanical resistance to a pylon passing through it, and which at the same time efficiently operates in both a negative and positive pressure regime. The sealing system of the invention can be easily installed by an installer without the necessity of entering the guideway's air duct, and avoids the creation of cavities associated with angled seals which can collect dust or moisture.

SUMMARY OF THE INVENTION

Briefly, the invention is an improved sealing system for a guideway slot formed in the support platform of a vehicle guideway used in a pneumatic transportation system. The slot sealing system of the invention provides two separate longitudinally extending pairs of sealing flaps for covering the guideway slot, namely, a first pair of opposed resilient sealing flaps having contacting distal edges forming a first seal interface and a second pair of opposed, resilient sealing flaps, similarly having contacting distal edges to form a second seal interface. It is contemplated that the first pair of sealing flaps will project outwardly of the guideway slot to provide a negative pressure seal, whereas the second pair of sealing flaps will project inwardly of the guideway slot to provide a positive pressure seal, with the first and second seal interfaces formed by the two pairs of sealing flaps being in opposition to each other such that the connecting member that joins a propulsion plate travelling in the guideway air duct to a vehicle travelling on the guideway support platform passes through both seal interfaces with minimal contact between the connecting member and the sealing flaps. In one embodiment of the invention, the right and left hand flaps of each pair of sealing flaps is fabricated of a separate strip of resilient material mounted to the support platform of the guideway. In another embodiment of the invention, the right hand sealing flap of both said first and second pairs of sealing flaps are formed by a single strip of resilient material, as are the left hand flaps. The strips of sealing material forming the pairs of sealing flaps can alternatively be mounted directly to the support platform or mounted via a mounting bracket arrangement, with the pairs of sealing flaps preferably being mounted along externally accessible mounting surfaces along the upper edge portions of the guide slot so that the pairs of sealing flaps can be installed from the top of the support platform.

Therefore, it can be seen that a primary object of the present invention is to provide a slot sealing system for the vehicle guideway of a pneumatic propulsion system, which efficiently seals the guideway slot in the presence of both positive and negative operating conditions in the guideway's air duct. It is another object of the invention to provide a slot sealing system which has low mechanical resistance and is relatively easy to install and maintain. It is a further object of the invention to provide such a sealing system without producing cavities in the region of the slot seal that can collect moisture or debris which can affect the operation and life of the slot seal. Other objects of the invention will be apparent from the following specification and claims.

DETAILED DESCRIPTION OF THE ILLUSTRATED EMBODIMENT

Figure 1A:
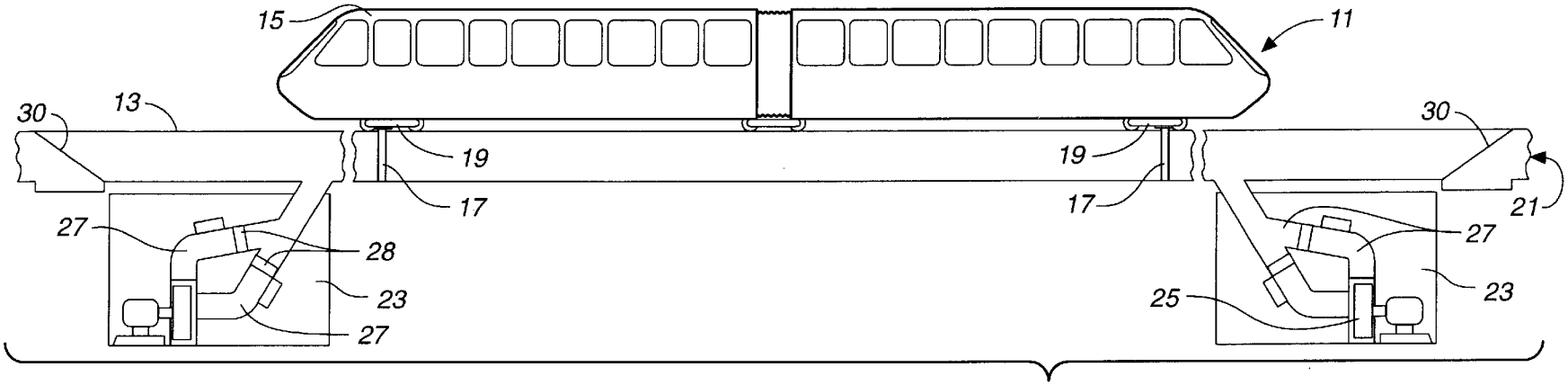
FIG. 1A is a graphic representation of a section of a pneumatic transportation system in which the slot sealing system of the present invention is used.
Figure 1B:
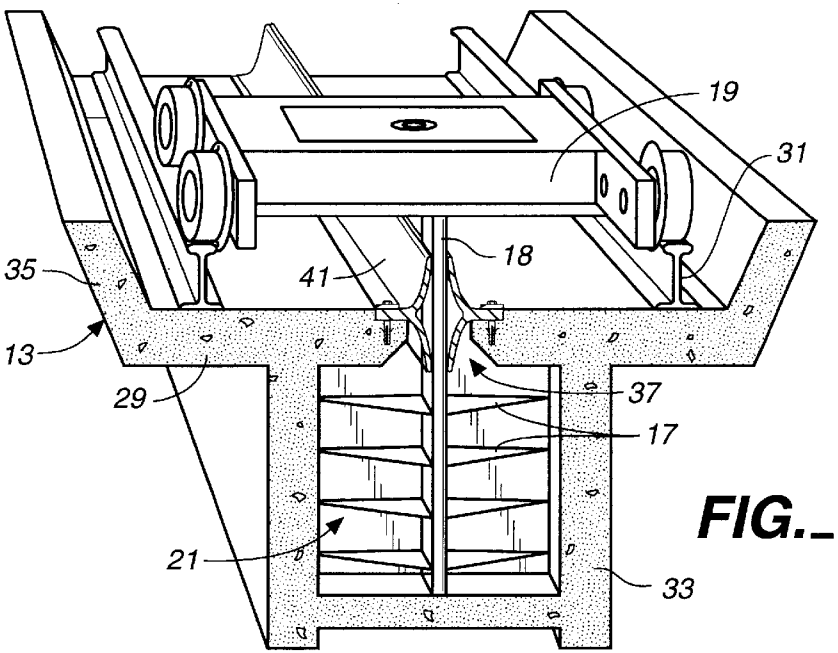
FIG. 1B is a cross-sectional view of the guideway of the pneumatic transportation system shown in FIG. 1A, illustrating the manner in which a propulsion plate in the guideway's air duct is connected to the vehicle's wheel carriage through a longitudinal guideway slot.

Referring now to the drawings, FIGS. 1A and 1B depict the basic components and operation of a pneumatic transportation system to which the guideway slot seal system of the present invention generally relates. As shown in FIG. 1A, pneumatic transportation system 11 includes a guideway 13 for supporting a vehicle 15 which is pneumatically propelled by means of propulsion plates 17 extending downwardly from two different wheel carriages 19 of the propelled vehicle. Propulsion plates 17, which are deployed in an air duct 21 formed in the guideway, propel vehicle 15 in response to air flow and pressure differentials generated through the air duct by means of suitably spaced power propulsion units 23 having electrically powered blowers 25, connecting duct work 27 and control valves 28. More specifically, by selective operation of control valves 28 and guideway section isolation valves 30, the power propulsion units selectively create air flow and resulting positive or negative pressures in the air duct in advance of and behind the propulsion plates 17 to propel the vehicle at a desired speed and in a desired direction. Hence, at any given time, any particular section of the guideway air duct 21 may experience either a negative air pressure or a positive air pressure, depending on the position of vehicle 15 along the guideway and the operating conditions of the power propulsion units and associated guideway valves 30 and power propulsion unit valves 28.

FIG. 1B shows in greater detail the construction of the guideway 13, how the vehicle's propulsion plates 17 are deployed in the guideway's air duct 21, and the coupling of the propulsion plates to the vehicle through a guideway slot. Guideway 13, which is suitably fabricated and assembled in precast concrete sections, is seen to include a horizontal support platform 29 for vehicle track 31, a downwardly extending base portion 33 in which the air duct 21 of the guideway is formed, and lateral guard walls 35 extending upwardly from the edges of the support platform. The propulsion plate 17 shown in the guideway's air duct is connected to one of the vehicle's wheel carriages 19 by means of a connecting member in the form of pylon 18 which extends downwardly from the wheel carriage through slot 37 which is formed in and runs longitudinally along the center of the guideway support platform 29. As the propulsion plates 17 propel the vehicle 15 along the guideway track 31 in response to air flow in air duct 21 the traveling pylon 18 connecting the propulsion plate to the vehicle wheel carriage will pass through the guideway slot and the slot sealing system of the invention which is described below.

Figure 2:
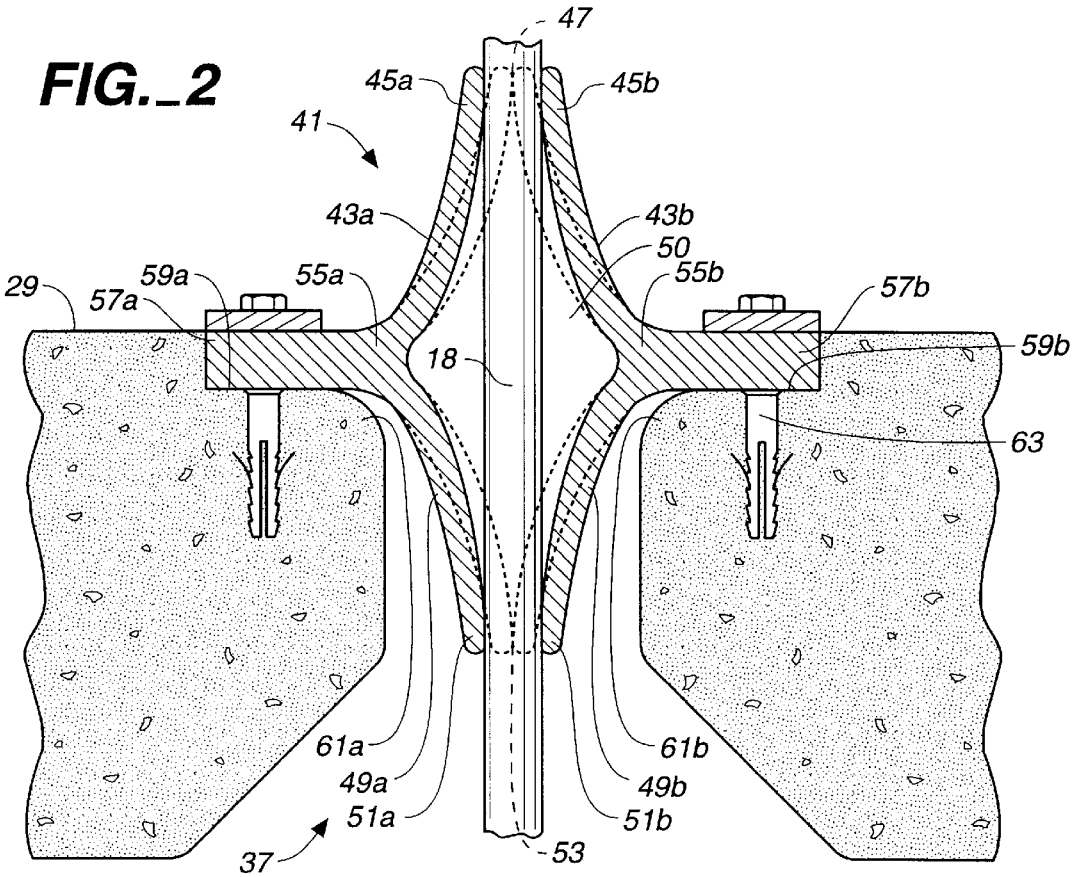
FIG. 2 is a cross-sectional view in side elevation of a slot sealing system in accordance with the invention showing the deflection of the slot seal as the propulsion plate pylon passes therethrough.
Figure 2A:
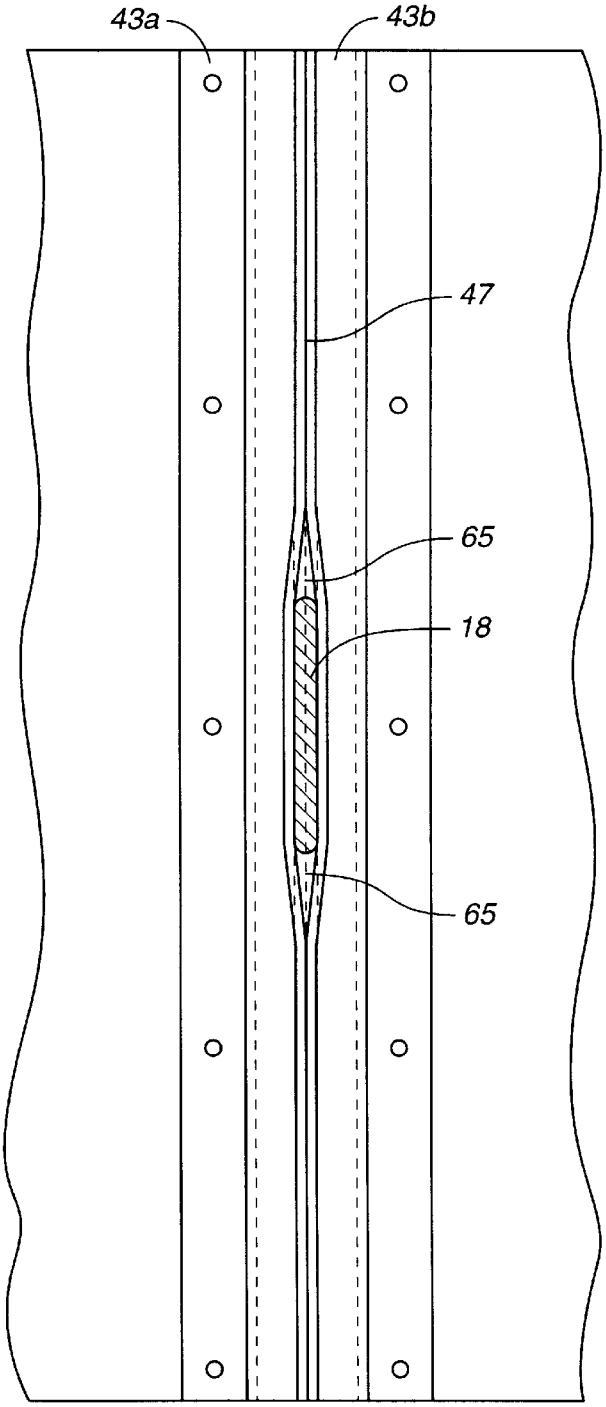
FIG. 2A is a top plan view of the slot sealing system shown in FIG. 2 over a short length of guideway and further showing the deflection of the slot seal as the propulsion plate pylon passes therethrough.

FIGS. 2 and 2A show an illustrative embodiment of the invention wherein guideway slot 37 formed in the guideway support platform 29 is sealed by means of a slot sealing system 41 comprised of at least two pairs of opposed resilient sealing flaps, namely, a first pair of opposed resilient sealing flaps 43*a*, 43*b*, having contacting distal edges 45*a*, 45*b* which form a first seal interface 47, and a second pair of opposed resilient sealing flaps 49*a*, 49*b* having contacting distal edges 51*a*, 51*b* which form a second seal interface 53. Seal interfaces 47, 53 are centered over and extend longitudinally along the guideway slot in opposition to each other such that pylon 18 is permitted to pass through both seal interfaces of the sealing system as the vehicle travels along the guideway. It can be seen that the first pair of sealing flaps 43*a*, 43*b* projects outwardly of the air duct of the vehicle guideway so as to form a negative pressure seal, that is, a seal that tends to close in the presence of negative pressure on the air duct side of the seal as compared to atmospheric pressure outside the air duct, while the second pair of sealing flaps 49*a*, 49*b* project inwardly of the air duct so as to form a positive pressure seal, that is, a seal that tends to close in the presence of positive pressure in the air duct, again as compared to atmospheric pressure. Also, the opposed pairs of sealing flaps 43, 49 form a small internal buffering air passageway 50 which runs between the opposed positive and negative pressure seals, and which is capable of providing turbulence between the seal interfaces for improved sealing function. It can be seen that the only contact between the pylon and the sealing flaps occurs at the flap's distal ends, and thus the pylon incurs minimal mechanical resistance as it passes through the seal.

In the sealing system illustrated in FIGS. 2 and 2A, the two pairs of sealing flaps 43, 49 are formed by means of two opposed strips of resilient material, namely, a left hand seal strip 55*a* which incorporates left hand flaps 43*a*, 49*a*, and a right hand seal strip 55*b* which incorporates right hand flaps 43*b*, 49*b*. Each of the left and right hand seal strips has an integral base portion which includes a laterally extending mounting edge 57*a*, 57*b* securable to one of the externally accessible mounting surfaces 59*a*, 59*b* running along the longitudinal upper edge portions 61*a*, 61*b* of the guideway slot. Thus, it can be seen that the slot sealing system of the invention can be easily installed by a worker standing on top of the guideway support platform 29 by simply laying out the left and right hand sealing strips 55*a*, 55*b* over the top edge portions of the guideway slot and securing the mounting edges 57*a*, 57*b* to the recessed mounting surfaces 59*a*, 59*b* by means of suitable anchor bolts 63 at suitable predrilled intervals along the guideway slot. Once installed, the upwardly projecting sealing flaps 43*a*, 43*b* (which provide the negative pressure seal for the sealing system) eliminate cavities across the top of the seal which could collect moisture or debris. Also, as seen in FIGS. 2 and 2A, the outwardly projecting negative pressure sealing flaps 43*a*, 43*b*, as well as the inwardly projecting positive pressure sealing flaps 49*a*, 49*b*, minimally deflect as the pylon 18 passes through the seal, thus leaving minimal openings 65 at either end of the pylon through which air leakage can occur. This is to be compared with the deflection of the prior art seal 67 illustrated in FIGS. 3 and 3A described below.

Seal strips 55*a*, 55*b* are preferably fabricated of neoprene rubber or other suitable resilient material that is durable, fire resistant, and resistant to ultraviolet light. The material used for the flaps should also provide low friction surfaces to reduce friction between the flaps and the traveling pylons where contact occurs. It is also understood that each of the seal strips 55*a*, 55*b* could be fabricated in two upper and lower sections by separating the strips along their mounting edges 57*a*, 57*b* as denoted by the phantom line 58 through mounting edge 57*b* of strip 43*b* shown in FIG. 2.

Figure 3:
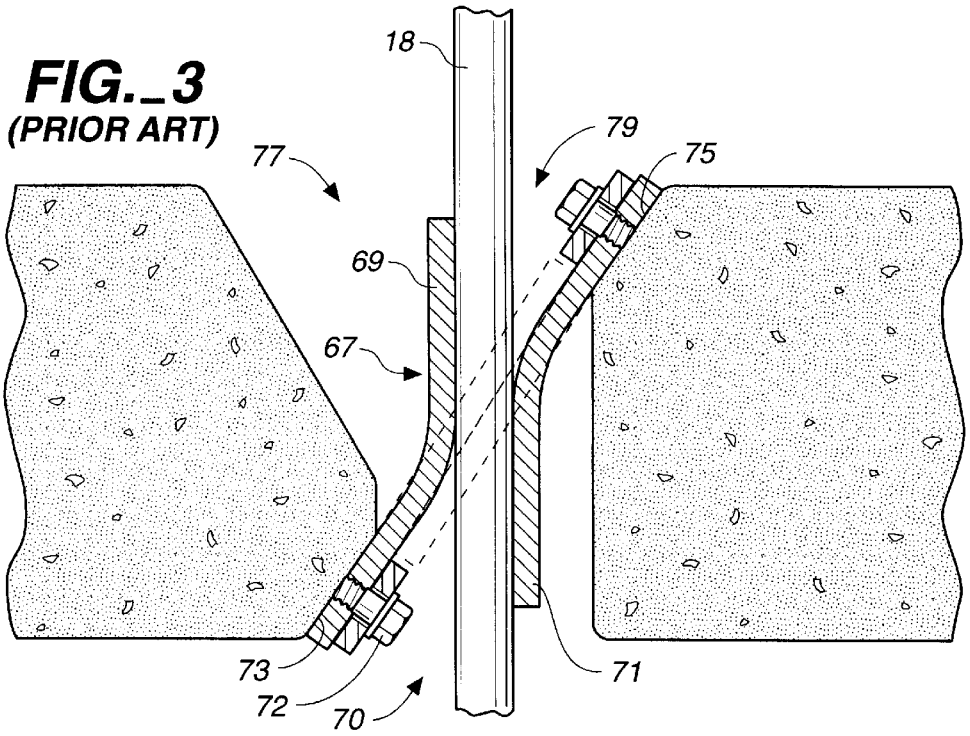
FIG. 3 (PRIOR ART)
FIG. 3 is a cross-sectional view in side elevation of a prior art slot sealing system showing the deflection of the slot seal as the propulsion plate pylon passes therethrough.
Figure 3A:
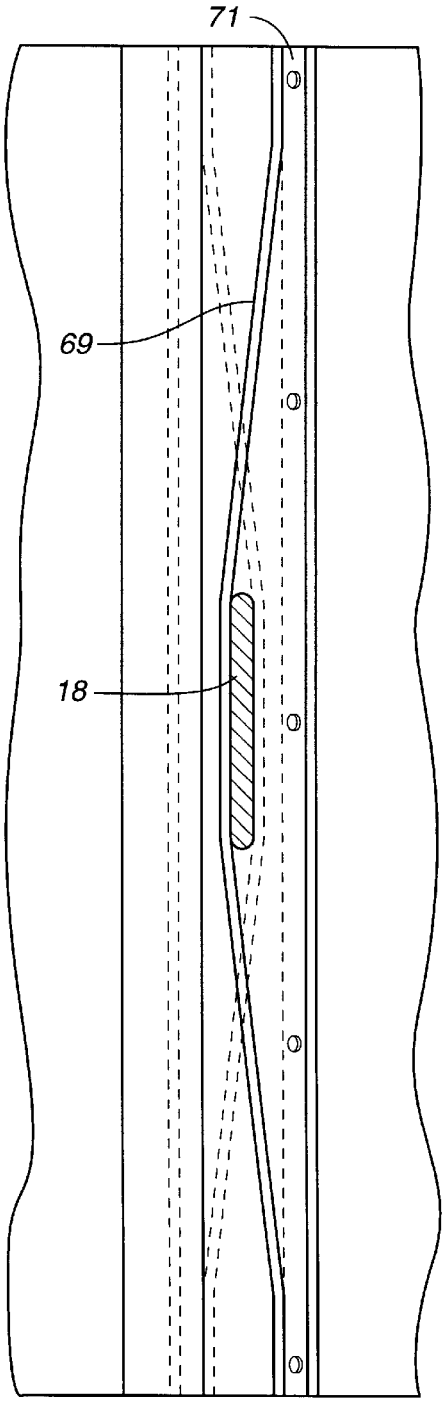
FIG. 3A (PRIOR ART)
FIG. 3A is a top plan view of the prior art slot sealing system shown in FIG. 3 over a short length of guideway and further showing the deflection of the slot seal as the propulsion plate pylon passes therethrough.

FIGS. 3 and 3A show an example of a conventional angled slot seal 67 wherein two overlapping sealing flaps 69, 71 are mounted in opposed relation by mounting the base end of the left hand sealing flap 69 to a bottom edge 73 of the guideway slot and the base end of the right hand sealing flap 71 to a top edge 75 of the guideway slot diagonally opposite bottom edge 73. As pylon 18 passes through this prior art slot seal, the left hand sealing flap 69 deflects upwardly and the right hand flap 71 downwardly as shown in FIG. 3, resulting in a displacement of the flap over a substantial portion of its length as shown in FIG. 3A, and resulting in increased air leakage at the pylon. As shown in FIG. 3, there is a substantial area of resistance producing contact between this prior art seal and the travelling pylon; also, cavities (such as the cavities denoted by the numerals 77 and 79) are produced which can collect moisture and debris which affect the performance and life of the seal. Further, the seal shown in FIGS. 3 and 3A are relatively difficult to install in that the left hand flap 69 must be attached to the bottom edge 73 of guideway slot 70 from inside the guideway's air duct since anchor bolts 72 securing this flap are not accessible from the outside of the guideway.

Figure 4:
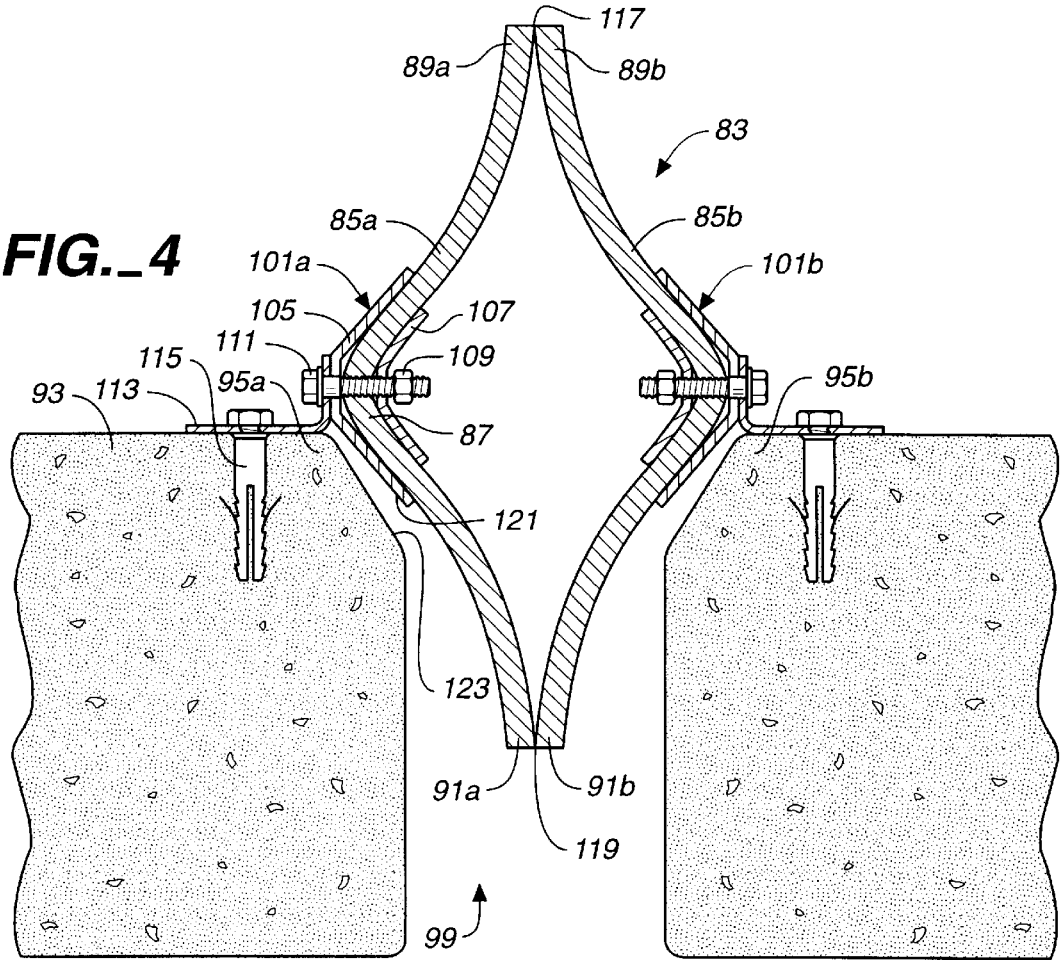
FIG. 4 is a side elevational view in cross-section of an alternative embodiment of the slot sealing system of the invention wherein two sealing strips are mounted along the guideway slot by means of mounting brackets.

FIGS. 4–7 illustrate alternative embodiments of the slot seal system of the present invention and means for mounting the sealing flaps of the slot system to the guideway slot. In FIG. 4, opposed seal strips 85*a*, 85*b* of the slot sealing system 83 provide the outwardly projecting first pair of opposed sealing flaps 89*a*, 89*b* for a negative pressure seal and the inwardly projecting pair of opposed sealing flaps 91*a*, 91*b* for a positive pressure seal. Seal strips 85*a*, 85*b* are mounted to the guideway support platform 93 along the upper edge portions 95*a*, 95*b* of the guideway slot 99 by means of first and second mounting bracket assemblies 101*a*, 101*b*, each of which includes a V-shaped base bracket 105 for receiving the center portion 87 of the seal strip, and a correspondingly V-shaped retainer 107 which depresses the strip's center portion into base bracket 105 by tightening down nuts 109 on retaining bolts 111 provided at suitable intervals along the base bracket. Each mounting bracket assembly further includes an L-shaped anchor bracket 113 which holds the base bracket 105 in its desired vertical position and which is anchored to the upper edge portions of the guideway slot by means of anchor bolts 115. It will be understood that the base bracket 105, retainer 107, and anchor bracket 113 of the mounting bracket assemblies are elongated elements that extend longitudinally along the edge of the slot. The length of the bracket elements can suitably range from about one meter or less in guideway curves up to about six meters in straight sections of guideway, with longer bracket elements being possible, including long elements shaped to the curve of the guideway. The small joints between abutting bracket elements should be sealed, suitably by a sealant such as Mastic™.

Installation of the slot sealing system shown in FIG. 4 can be accomplished in discreet lengths by pre-assembling each side of the slot seal system and then anchoring the pre-assembled length to the upper edge portions of the guide slot into suitably spaced pre-drilled holes for anchor bolts 115. The center portion 87 of each strip of sealing material 85 will be pre-drilled along its length to accommodate retention bolts 111 when the seal strip is placed between base bracket 105 and retainer 107. The forming of the inwardly directed distal ends of flaps 89*a*, 89*b*, 91*a*, 91*b* of each side of the seal is seen to occur when the retainer 107 is pulled down firmly onto the center portion of the sealing flap by retention nuts 109 so as to force the center portion of the sealing element into the base bracket 105. When installed as seen in FIG. 4, the flap ends of the opposed seal strips 85*a*, 85*b* contact each other to form negative pressure seal interface 117 and positive pressure seal interface 119. To accommodate the lower leg 121 of the base brackets, angled surfaces 123 are provided at the upper corners of the guideway slot.

Figure 5:
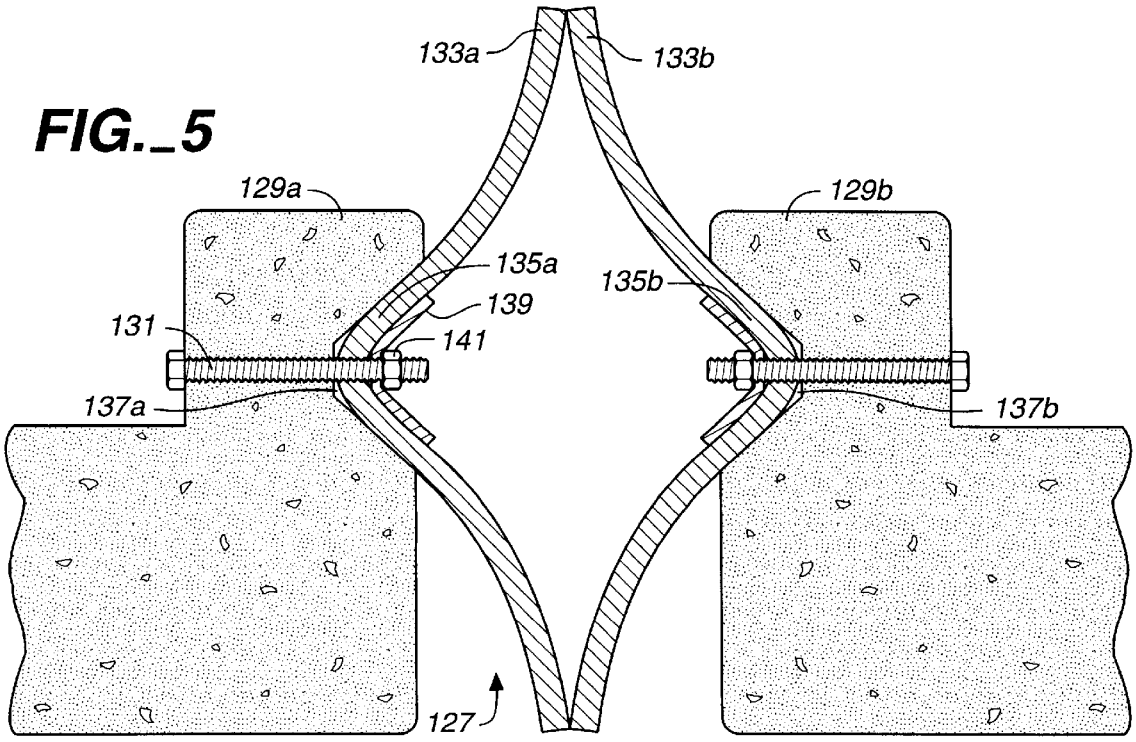
FIG. 5 is a side elevational view in cross-section of another alternative embodiment of the slot sealing system of the invention wherein two sealing strips are mounted directly to the edge of the guideway slot.

FIG. 5 shows an alternative to the sealing system shown in FIG. 4 wherein the upper edge portions of guide slot 127 are provided with raised shoulder portions 129*a*, 129*b* through which retention bolts 131*a*, 131*b* can be inserted for retaining opposed seal strips 133*a*, 133*b*. Except for the manner in which they are mounted to the guide slot 127, seal strips 133*a*, 133*b* are identical to the seal strips 85*a*, 85*b* shown in FIG. 4. However, instead of mounting the seal strips in separate clamp structures, their center portions 135*a*, 135*b* are held in longitudinally extending, opposed V-shaped recesses 137*a*, 137*b* formed in the interior surfaces of the raised shoulder portions 129*a*, 129*b*. A similar retainer 139 is used for depressing the center portion of each sealing strip into each of the V-shaped recesses as retention nuts 141 are tightened down on the retention bolts 131. The mounting scheme shown in FIG. 5 reduces the amount of mounting hardware required and would generally simplify the installation of the seal.

Figure 6:
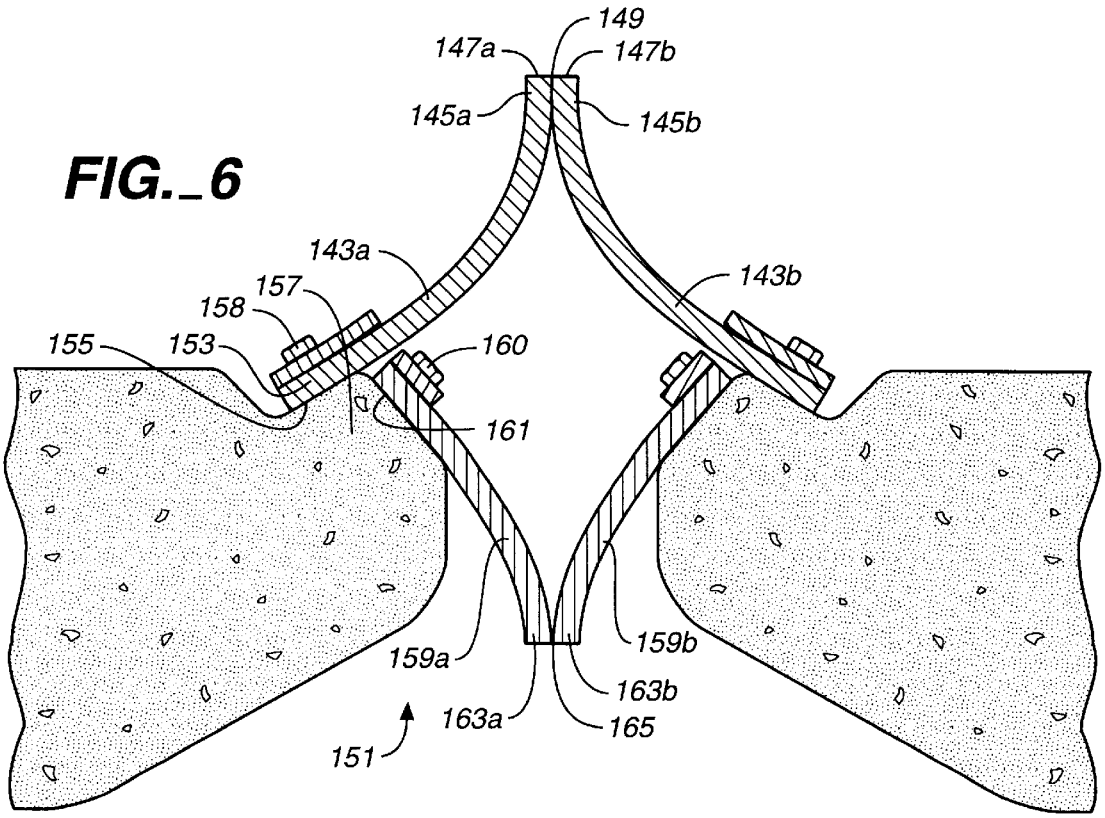
FIG. 6 is a side elevational view in cross-section of a further embodiment of the slot sealing system of the invention wherein four separate sealing strips are mounted directly to the guideway slot.

FIG. 6 illustrates an alternative slot sealing system in accordance with the invention wherein separate strips of sealing material are provided for each flap of each pair of sealing flaps. Specifically, in FIG. 6, outer seal strips 143*a*, 143*b* form a first pair of outwardly projecting, opposed, resilient sealing flaps 145*a*, 145*b* having contacting distal edges 147*a*, 147*b* that form a first, negative pressure seal interface 149 extending longitudinally along guideway slot 151. The base end 153 of each of the outer seal strips 145*a*, 145*b* are mounted directly to an outer, upwardly angled mounting surface 155 provided along the upper edge portion 157 of the guide slot so as to incline the outer seal strips toward each other in an outward projection. Interior seal strips 159*a*, 159*b* mounted by suitable anchor bolts 160 to interior, downwardly inclined mounting surfaces 161 form a second inwardly projecting pair of opposed sealing flaps having contacting distal edges 163*a*, 163*b* which form a second seal interface 165. The downward inclination of mounting surfaces 161 for the interior seal strips 159 provide the sealing flaps with the desired inward projection for forming a positive pressure seal in opposition to the negative pressure seal formed by outwardly projecting flaps 145*a*, 145*b*.

Installation of the sealing system of FIG. 6 is accomplished by first installing the interior seal strips 159*a*, 159*b* to mounting surfaces 161 by means of anchor bolts 160, and then separately installing the outer seal strips 143*a*, 143*b* along the outer mounting surfaces 155. Again, such installation can be accomplished from the top of the guideway where the mounting surfaces 155, 161 for the seal strips are fully accessible.

Figure 7:
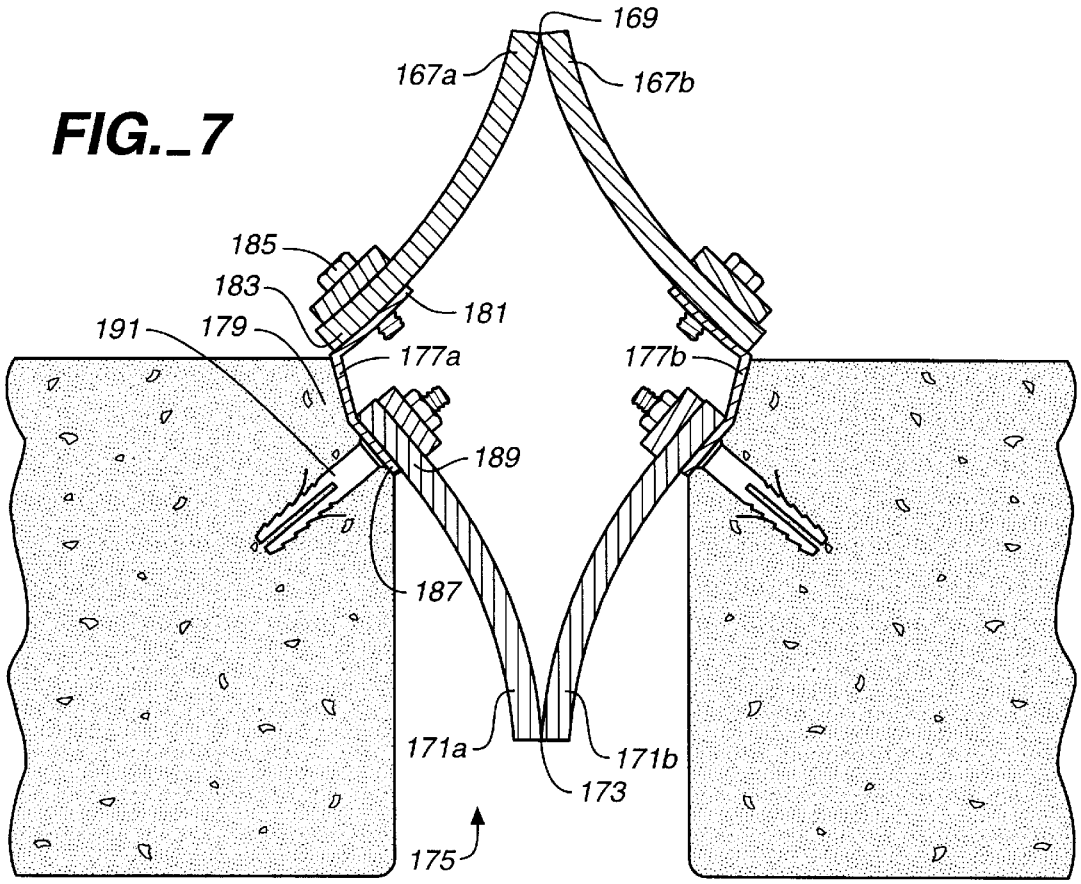
FIG. 7 is a side elevational view in cross-section of still another embodiment of the invention wherein four separate sealing strips are mounted to the guideway slot by means of mounting brackets.

FIG. 7 shows yet a further embodiment of the sealing system of the invention which, like the embodiment of FIG. 6, utilizes separate seal strips for each flap of the system's two pairs of sealing flaps. In FIG. 7, outwardly projecting sealing flaps 167*a*, 167*b* provide a first pair of sealing flaps forming a first negative pressure seal interface 169 whereas inwardly projecting seal strips 171*a*, 171*b* provide a second pair of sealing flaps forming a positive pressure seal interface 173. The seal strips 167, 171 are mounted over guideway slot 175 by means of opposed mounting brackets 177*a*, 177*b* anchored along the upper edge portions 179 of the guideway slot. Each opposing bracket 177*a*, 177*b* has an upwardly and inwardly projecting top leg 181 to which the base end 183 of one of the outwardly projecting seal strips is attached by means of fastener 185, and a downwardly and inwardly projecting bottom leg 187 to which the base end 189 of one of the inwardly projecting seal strips is attached. Anchor bolts 191 secure the brackets to the edge of the guide slot 175, as well as securing the inwardly projecting seal strips 171*a*, 171*b* to the bracket.

Therefore, it is seen that the present invention is a relatively easily installed and maintained slot sealing system for a pneumatic guideway system that provides both a negative and positive pressure seal with low mechanical resistance, and that produces minimum deflection of the slot seal as a pylon passes through the slot seal. While the slot sealing system of the invention has been described in considerable detail in the foregoing specification and the accompanying drawings, it is understood that it is not intended that the invention be limited to such detail or to the embodiments disclosed herein, except as necessitated by the following claims.

What I claim is:

1. In a vehicle guideway for a pneumatic transportation system wherein said guideway has a support platform for a vehicle track, an air duct below said support platform, and a longitudinal guideway slot in said support platform for receiving and passing a travelling connecting member that connects a propulsion plate within the air duct of the guideway to a vehicle travelling on the vehicle track, a guideway slot sealing system comprising a first pair of opposed resilient sealing flaps covering said guideway slot, said first pair of sealing flaps having contacting distal edges that form a first seal interface extending longitudinally of said guideway slot, the contacting distal edges of said first pair of sealing flaps forming a negative pressure seal at said first seal interface, and a second pair of opposed resilient sealing flaps covering said guideway slot, said second pair of sealing flaps having contacting distal edges that form a second seal interface extending longitudinally of said guideway slot, the contacting edges of said second pair of sealing flaps forming a positive pressure seal at said second seal interface, the first and second seal interfaces of said first and second pairs of sealing flaps being opposed to each other such that the connecting member travelling through the guideway slot is permitted to pass through both said seal interfaces.

2. The slot seal system of claim 1 wherein said first pair of sealing flaps projects outwardly of the air duct of said vehicle guideway to form a negative pressure seal.

3. The slot seal system of claim 1 wherein said second pair of sealing flaps projects inwardly of the air duct of said vehicle guideway to form a positive pressure seal.

4. The slot seal system of claim 1 wherein said first and second seal interfaces are both aligned substantially over the center of said guideway slot.

5. In a vehicle guideway for a pneumatic transportation system wherein said guideway has a support platform for a vehicle track, an air duct below said support platform, and a longitudinal guideway slot in said support platform for receiving and passing a travelling connecting member that connects a propulsion plate within the air duct of the guideway to a vehicle travelling on the vehicle track, a guideway slot sealing system comprising a first pair of opposed resilient sealing flaps covering said guideway slot, said first pair of sealing flaps having contacting distal edges that form a first seal interface extending longitudinally of said guideway slot, the contacting distal edges of said first pair of sealing flaps projecting outwardly of said air duct to form a negative pressure seal at said first seal interface, and a second pair of opposed resilient sealing flaps covering said guideway slot, said second pair of sealing flaps having contacting distal edges that form a second seal interface extending longitudinally of said guideway slot, the contacting edges of said second pair of sealing flaps projecting inwardly of said air duct to form a positive pressure seal at said second seal interface, the first and second seal interfaces of said first and second pairs of sealing flaps being opposed to each other such that the connecting member travelling through the guideway slot is permitted to pass through both said seal interfaces.

6. The slot seal system of claim 5 wherein said first and second pairs of sealing flaps each consists of a right hand flap and a left hand flap, and wherein each said right and left hand flap is fabricated of a separate strip of resilient material mounted to the support platform of said guideway along the guideway slot thereof so as to form opposed pairs of sealing flaps that project both outwardly and inwardly of said guideway slot.

7. The slot seal system of claim 5 wherein said first and second pairs of sealing flaps each consists of a right hand flap and a left hand flap, wherein the right hand flap of both said first and second pairs of flaps is formed by a first strip of resilient material mounted to the support platform of said guideway along the guideway slot thereof so as to project outwardly and inwardly of said guideway slot, the left hand flap of both said pairs of flaps is formed by a second strip of resilient material mounted to the support platform of said guideway along the guideway slot thereof so as to project outwardly and inwardly of said guideway slot in opposition to said first strip of resilient material, whereby said first and second strips of resilient material form opposed pairs of sealing flaps that project both outwardly and inwardly of said guideway slot.

8. The slot seal system of claim 5 wherein said first and second pairs of sealing flaps each consists of a right hand flap and a left hand flap, and wherein said slot seal system further comprises a first mounting bracket for mounting the right hand flaps of both said pairs of flaps to the support platform of said guideway along the guideway slot thereof and a second mounting bracket for mounting the left hand flaps of both said pairs of flaps to the support platform of said guideway along the guideway slot thereof in opposed relation to said right hand pairs of flaps.

9. The slot seal system of claim 5 wherein both said first and second pairs of sealing flaps are mounted to the support platform of said guideway along the guide slot thereof so as to be installable from outside the air duct below said support platform.

10. The slot seal system of claim 9 wherein the guide slot in said support, platform is provided with opposed longitudinal upper edge portions having externally accessible mounting surfaces and wherein said pairs of sealing flaps are mounted to said externally accessible mounting surfaces.

11. The slot seal system of claim 9 wherein said pairs of sealing flaps are removably mounted to the support platform of said guideway along the guide slot thereof whereby both pairs of sealing flaps can be readily replaced.

12. A vehicle guideway for a pneumatic transportation system having vehicles that ride on a vehicle track and that have propulsion plates connected thereto by connecting members, said vehicle guideway comprising a support platform for supporting a vehicle track over which the vehicles of said pneumatic transportation system travel, an air duct below said support platform for receiving the propulsion plates of said vehicles, a longitudinal guideway slot in said support platform for receiving and passing connecting members of a vehicle travelling on the vehicle track, said guideway slot including opposed longitudinal upper edge portions having externally accessible mounting surfaces, a first pair of opposed resilient sealing flaps mounted to accessible mounting surfaces of said guideway slot, said first pair of sealing flaps having contacting distal edges that form a first seal interface extending longitudinally of said guideway slot, the contacting distal edges of said first pair of sealing flaps projecting outwardly of said air duct to form a negative pressure seal at said first seal interface, and a second pair of opposed resilient sealing flaps mounted to accessible mounting surfaces of said guideway slot, said second pair of sealing flaps having contacting distal edges that form a second seal interface extending longitudinally of said guideway slot, the contacting edges of said second pair of sealing flaps projecting inwardly of said air duct to form a positive pressure seal at said second seal interface, the first and second seal interfaces of said first and second pairs of sealing flaps being opposed to each other such that the connecting member travelling through the guideway slot is permitted to pass through both said seal interfaces with minimal contact between the sealing flaps and connecting member.

* * * * *